US006360810B1

(12) United States Patent
Shaffer

(10) Patent No.: US 6,360,810 B1
(45) Date of Patent: Mar. 26, 2002

(54) VACUUM INDUCTION MELTING SYSTEM

(75) Inventor: Sterry A. Shaffer, Matthews, NC (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 09/256,463

(22) Filed: Feb. 23, 1999

(51) Int. Cl.[7] ..... B22D 27/15; B22D 27/02

(52) U.S. Cl. ..... 164/258; 164/513; 164/256; 164/254; 219/647; 373/142; 266/211

(58) Field of Search ..... 164/513, 258, 164/256, 254, 493, 61, 65; 219/647; 373/141, 142, 143; 266/211

(56) References Cited

U.S. PATENT DOCUMENTS

| | | | | |
|---|---|---|---|---|
| 2,241,687 A | * | 5/1941 | Warnke | 439/196 X |
| 2,625,719 A | | 1/1953 | Moore | |
| 2,825,945 A | * | 3/1958 | Ulrech et al. | |
| 2,854,228 A | * | 9/1958 | Franks et al. | 266/211 |
| 3,014,255 A | | 12/1961 | Bussard et al. | |
| 3,536,125 A | | 10/1970 | Blasko et al. | |
| 3,554,268 A | | 1/1971 | Taylor et al. | |
| 3,653,426 A | | 4/1972 | Groteke et al. | |
| 3,687,191 A | | 8/1972 | Hulit et al. | |
| 3,863,706 A | | 2/1975 | Chandley et al. | |
| 4,055,216 A | | 10/1977 | Ulyanov et al. | |
| 4,280,550 A | | 7/1981 | Roberts | |
| 4,773,079 A | | 9/1988 | Brückmann et al. | |
| 5,125,004 A | * | 6/1992 | Roberts et al. | 373/143 |
| 5,271,033 A | * | 12/1993 | Bethge et al. | 373/143 |
| 5,329,989 A | | 7/1994 | Wilson | |
| 5,343,492 A | | 8/1994 | Henn | |
| 5,526,375 A | | 6/1996 | Binder et al. | |
| 5,540,272 A | | 7/1996 | Freeman | |

FOREIGN PATENT DOCUMENTS

| | | | | |
|---|---|---|---|---|
| GB | 843975 | * | 8/1960 | 164/258 |
| JP | 62-134143 | * | 6/1987 | 164/258 |
| SU | 535356 | * | 12/1976 | 266/211 |

* cited by examiner

*Primary Examiner*—Nam Nguyen
*Assistant Examiner*—I.-H. Lin
(74) *Attorney, Agent, or Firm*—Alston & Bird LLP

(57) ABSTRACT

A vacuum induction melting system includes a melt chamber which forms an airtight enclosure, with an induction furnace located within the melt chamber. A mold tunnel is connected to the melt chamber adjacent its lower end, with the mold tunnel including a pour opening which communicates with the melt chamber and through which molten metal poured from the furnace can enter the mold tunnel. A mold carriage is positioned within the mold tunnel for receiving and carrying one or more molds adapted for receiving molten metal. An isolation valve is located between the melt chamber and the mold tunnel for isolating the mold tunnel from the melt chamber to allow for removing the mold carriage from the mold tunnel for loading or unloading of molds thereon. A mold transport assembly is provided for moving the mold carriage from a pouring position within the mold tunnel to a loading position located outside of the mold tunnel. An evacuation system is connected to the melt chamber, the charging chamber and the mold tunnel for producing a vacuum therein.

18 Claims, 9 Drawing Sheets

VACUUM INDUCTION MELTING SYSTEM

FIELD OF THE INVENTION

This invention relates to a vacuum melting system, and more particularly, to a system for melting and vacuum refining metals.

BACKGROUND OF THE INVENTION

Vacuum induction melting has been widely used for producing high performance metals and alloys. Typically, the melting takes place in a refractory-lined electric induction furnace located within a vacuum chamber. The furnace is charged with raw materials, then heated under vacuum until the raw materials reach a molten state and volatile impurities are refined from the melt. Then the furnace is typically tilted to pour the molten metal into one or more molds positioned for receiving the molten metal. The physical handling of the furnace and the successive heating and cooling cycles result in wear or damage to the refractory lining, with the result that it is necessary periodically to remove the induction furnace from the vacuum chamber and to repair or replace the refractory lining. This results in downtime and loss of productivity while the furnace is being removed for rebuilding and replaced by a rebuilt furnace. Also, it is sometimes necessary to replace the furnace to avoid contamination when changing to the production of a different alloy.

Many of the commercially available vacuum induction melting systems are operated on a batch-wise basis, with the vacuum chamber being opened after each melt so that the furnace can be recharged with raw materials, and other components, such as the tundish or launder can be replaced or rebuilt. Vacuum induction melting systems have been proposed which allow the vacuum melt chamber to be isolated from other chambers, for example the mold tunnel, sot filled molds can be removed and replaced by empty molds. Nonetheless, these systems are limited in their capability for being operated for extended periods of time in a continuous or semi-continuous manner.

SUMMARY OF THE INVENTION

The present invention provides a vacuum induction melting system which is designed to reduce downtime and to facilitate operation in a continuous or semi-continuous manner for extended periods of time to thereby significantly increase the efficiency of the melting system. The vacuum induction melting system of the present invention is also designed to make it possible to easily and quickly remove the induction furnace from the melt chamber when it becomes necessary to replace and rebuild the furnace.

The vacuum induction melting system of the present invention includes a melt chamber which forms an airtight enclosure, with an induction furnace located within the melt chamber. A charging chamber is communicatively connected to the melt chamber adjacent its upper end. The charging chamber includes a door providing access to the interior of the charging chamber so that a charge of raw materials can be placed therein. An isolation valve is located between the melt chamber and the charging chamber and is movable between open and closed positions. In the closed position, the charging chamber is isolated from the melting chamber to allow for loading of raw materials into the charging chamber through a door provided in the charging chamber. In the open position, the charging chamber is in communication with the melt chamber to permit adding the charge of raw materials to the induction furnace. A mold tunnel is connected to the melt chamber adjacent its lower end, with the mold tunnel including a pour opening which communicates with the melt chamber and through which molten metal poured from the furnace can enter the mold tunnel. A mold carriage is positioned within the mold tunnel for receiving and carrying one or more molds adapted for receiving molten metal. An isolation valve is located between the melt chamber and the mold tunnel and is movable between an open and a closed position. In the closed position, the mold tunnel is isolated from the melt chamber to allow for removing the mold carriage from the mold tunnel for loading or unloading of molds thereon. In the open position, the mold tunnel is in communication with the melt chamber so that molds can be filled with molten metal. A mold transport assembly is provided for moving the mold carriage from a pouring position within the mold tunnel to a loading position located outside of the mold tunnel. An evacuation system is connected to the melt chamber, the charging chamber and the mold tunnel for producing a vacuum therein.

In a preferred embodiment, the melt chamber is provided with a fixed side wall and a movable side wall which is detachably connected to the fixed side wall. A furnace transport assembly is connected to the movable side wall and to the induction furnace. The furnace transport assembly makes it possible to move to the side wall and the furnace laterally until the furnace is removed from the melt chamber. By having a side opening melt chamber, the furnace can be much more readily removed from the melt chamber than in prior conventional configurations where the top of the melt chamber must be removed and the furnace lifted from the melt chamber.

In a more specific aspect, the furnace transport assembly includes laterally extending rails which are positioned for receiving and supporting the movable side wall and the induction furnace. The rails include a pair of narrow gauge fixed rail segments located within the melt chamber for supporting the furnace when the furnace is located within the melt chamber. In addition, a pair of wide gauge fixed rail segments are located at a lateral location distal from the melt chamber. A pair of movable rail segments are located proximal to the melt chamber and a rail adjustment mechanism is provided for adjusting the spacing of the movable rail segments from a wide gauge corresponding to the gauge of the wide gauge fixed rail segments and to the a narrow gauge corresponding to a pair of narrow gauge fixed rail segments located within the melt chamber for supporting the furnace when it is located within the melt chamber.

In a further aspect, the melting system includes a launder chamber which is communicatively connected to the melt chamber and having a door providing access to the launder chamber, and also including a launder adapted for receiving molten metal from the furnace. An isolation valve is located between the melt chamber and the launder chamber and is movable between opened and closed positions, the closed position isolating the launder chamber from the melt chamber to permit positioning of the launder in a loading position within the launder chamber through said door thereof, and the open position providing communication between the launder chamber and the melt chamber to permit moving the launder to a pour position within the melt chamber. A launder transport assembly cooperates with the launder for moving the launder from a loading position within the launder chamber to a pour position within the melt chamber where it is positioned for receiving molten metal poured from the furnace and for discharging the molten metal through the pour opening into the mold tunnel.

BRIEF DESCRIPTION OF THE DRAWINGS

Some of the features and advantages of the invention having been stated, others will become apparent from the detailed description which follows, and from the accompanying drawings, in which;

FIG. 7 is a fragmentary detail cross sectional view of the launder taken substantially along the line 7—7 of FIG. 6;

DETAILED DESCRIPTION

The present invention now will be described more fully hereinafter with reference to the accompanying drawings, in which an illustrative embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
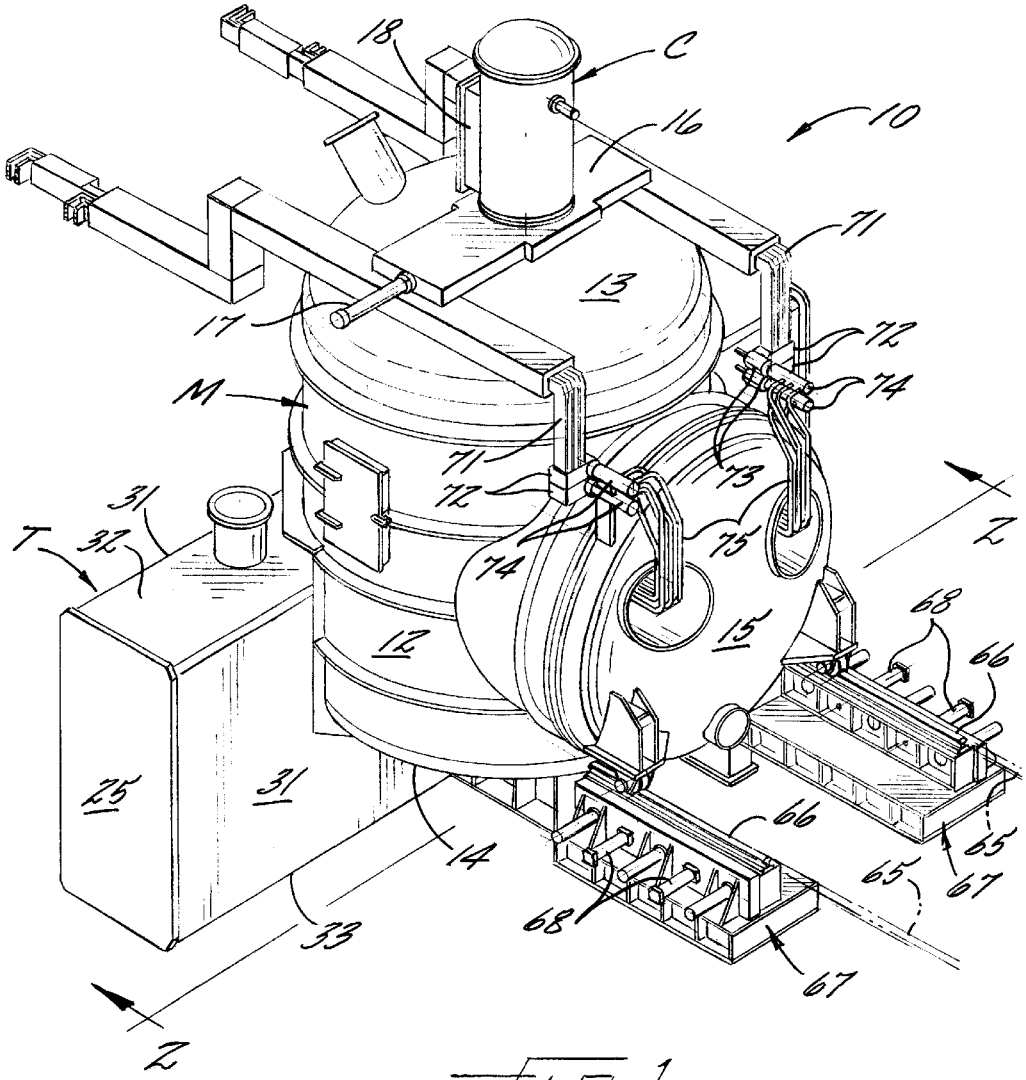
FIG. 1 is a front perspective view showing a vacuum induction melting system in accordance with the present invention.

The vacuum induction melting system is indicated generally by the reference character 10. As shown, in FIG. 1, the vacuum induction melting system 10 includes a melt chamber M, a charging chamber C at the upper end of the melt chamber and an elongate generally horizontally extending mold tunnel T which is communicatively connected to the melt chamber adjacent its lower end. In addition, a launder chamber L extends from one side of the melt chamber M. The charging chamber C, the mold tunnel T and the launder chamber L each communicate with the interior of the melt chamber M but can be individually isolated therefrom by respective isolation valves, to be described more fully below. The melt chamber M, the charging chamber C, the mold tunnel T, and the launder chamber L are each connected to an evacuation system V which is capable of producing vacuum conditions in the respective chambers.

The melt chamber M is in the form of a large generally cylindrical tank having generally cylindrical fixed side walls 12 with a dome-shaped circular top wall 13 and bottom wall 14 joined to the side walls. The melt chamber M also includes a moveable side wall 15 in the form of a generally cylindrical circular door or hatch. The charging chamber C, which is of a cylindrical configuration, extends upwardly from the top wall 13 of the melt chamber M, with the interior of the charging chamber C communicating with the interior of the melt chamber M via an opening formed in the top wall 13. An isolation valve 16 is mounted at the juncture of the charging chamber C with the melt chamber. In the illustrated embodiment, the isolation valve 16 is a sliding gate valve which can be moved between an open and a closed position by a hydraulic actuator 17. In the closed position, the interior of the charging chamber C is isolated from the melt chamber to permit loading the charging chamber with a charge of raw materials through an access door or hatch 18. The raw materials may be placed in a bucket having an openable bottom. Once the raw materials have been placed in the charging chamber, the access door 18 may be closed and the charging chamber may be pumped down until vacuum conditions comparable to the vacuum in the melt chamber M have been established whereupon the isolation valve 16 may be opened and the bucket of raw materials may be lowered into the melt chamber.

Figure 4:
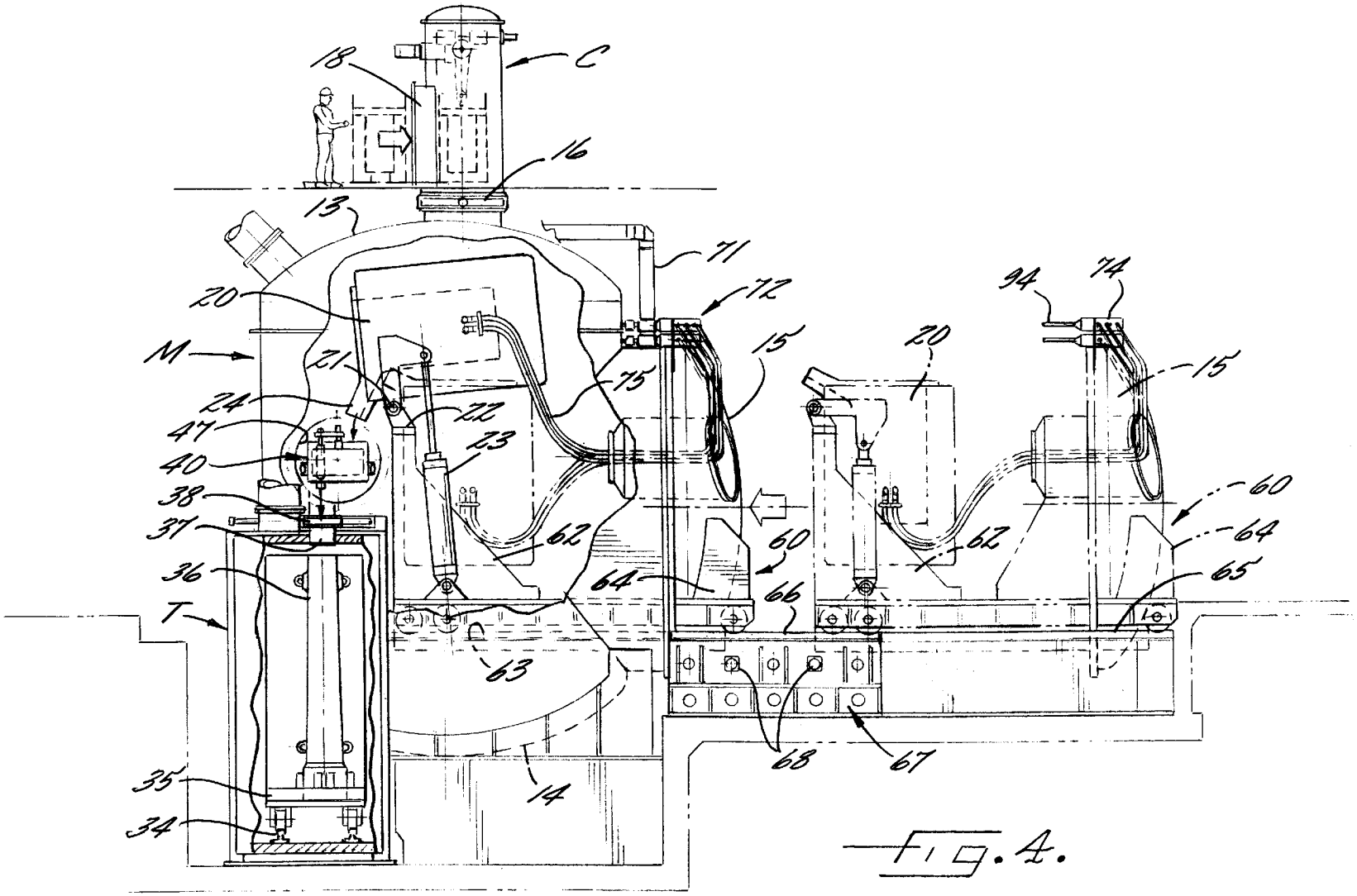
FIG. 4 is a side elevational view taken substantially along the line 4—4 of FIG. 3.
Figure 5:
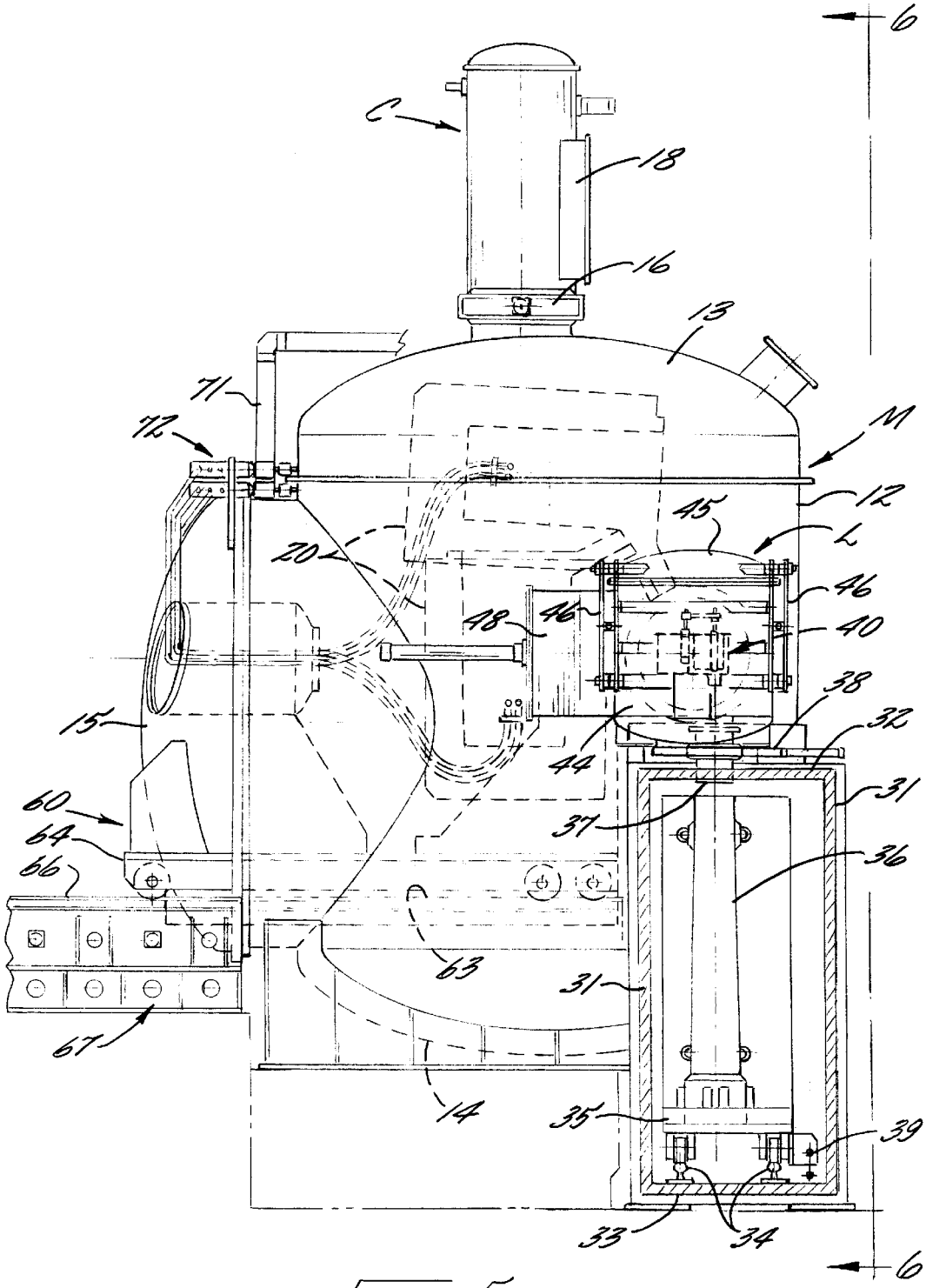
FIG. 5 is a side elevational view of the opposite side of the melting system; taken substantially along the line 5—5 of FIG. 3.

Located inside the melt chamber M is a melting furnace 20, best seen in FIG. 4. In the illustrated embodiment, the melting furnace 20 is an electric induction furnace having a refractory lining and an open upper end. The furnace is heated by electric induction coils located in the walls of the furnace. The furnace 20 is mounted for tilting movement between an upright melting position as shown in broken lines in FIG. 4 and a tilted pour position as shown in solid lines.

Figure 2:
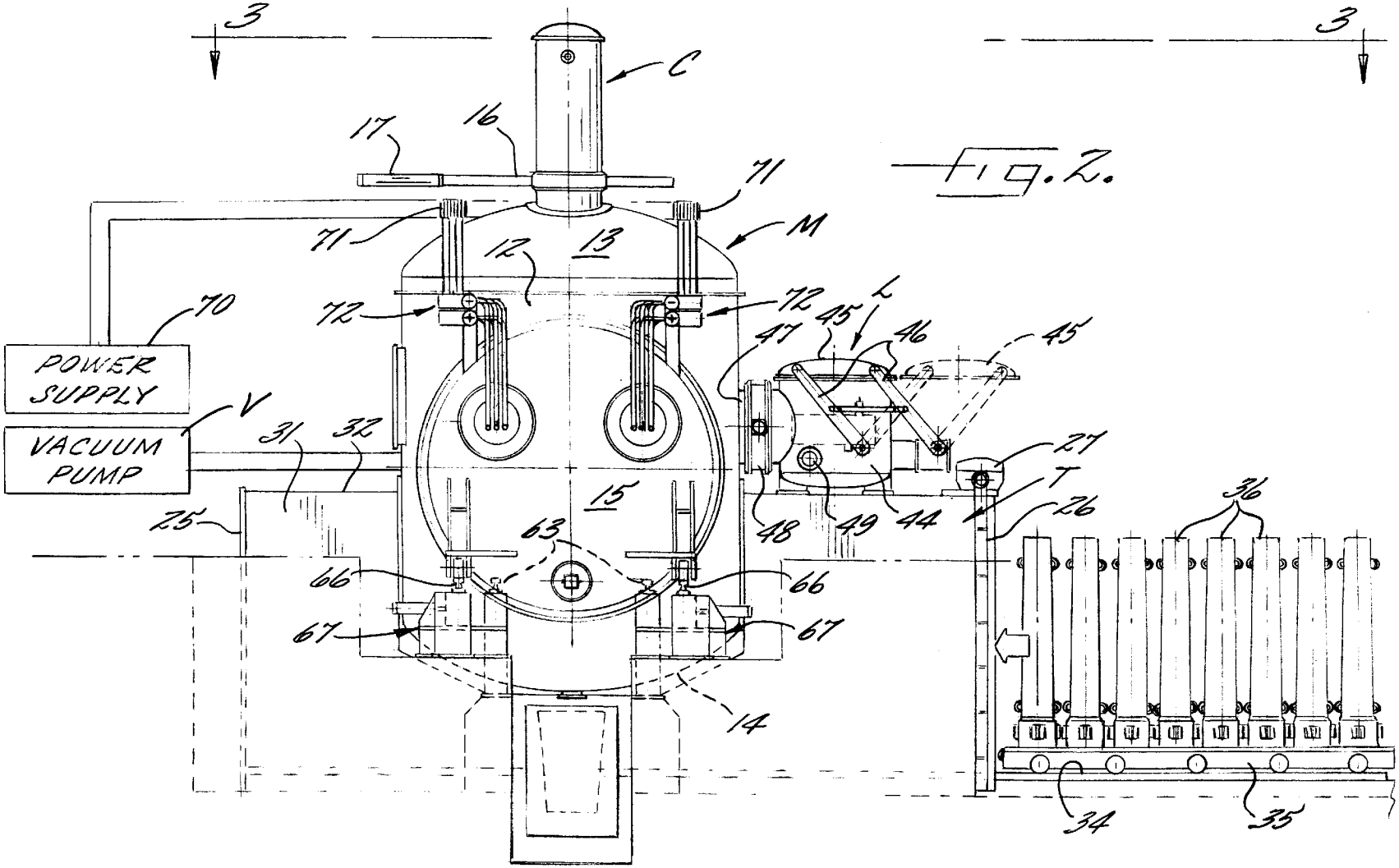
FIG. 2 is a schematic front elevational view thereof taken substantially along the line 2—2 of FIG. 1.
Figure 3:
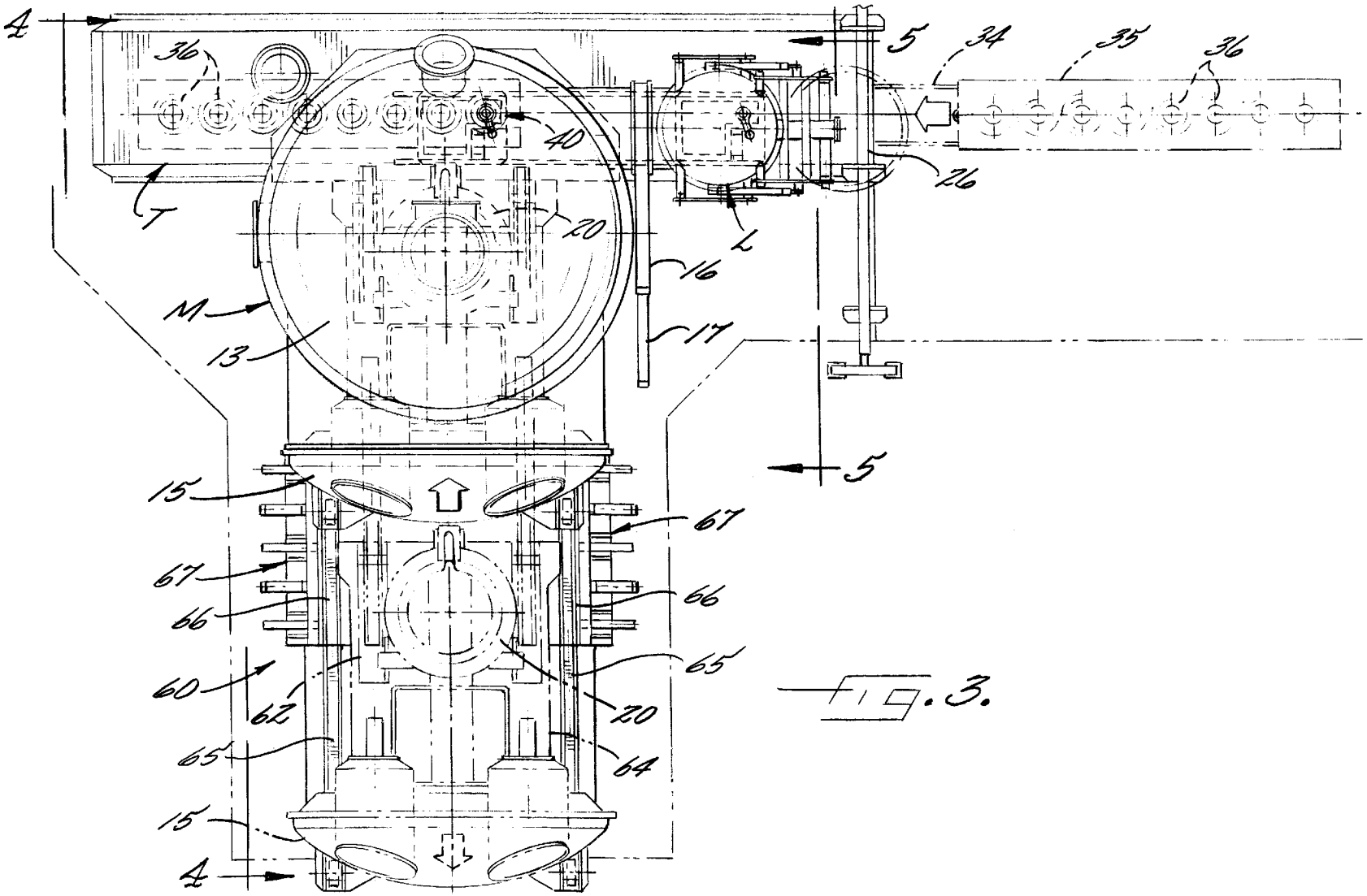
FIG. 3 is a top plan view taken substantially along the line 3—3 of FIG. 2 and showing how the melt chamber can be opened for removal of the melting furnace.

The mold tunnel T is of an elongate rectangular configuration and includes a pair of opposed generally parallel reinforced side walls 31, reinforced top wall 32 and bottom wall 33. A fixed end wall 25 closes one end of the mold tunnel T and a sliding wall or gate 26, powered by an actuator assembly 27, closes the opposite end. Suitable reinforcements, such as I-beams, not shown, allow the walls of the mold tunnel T to withstand the pressure differential when the mold tunnel is under vacuum conditions. As best seen in FIGS. 2 and 3, the mold tunnel T intersects a lower quadrant portion of the melt chamber M. A pair of rails 34 extend longitudinally along the bottom of the mold tunnel supporting a wheeled mold carriage 35. The mold carriage 35 has a flat horizontally extending upper surface upon which rests a series of upright cylindrical molds 36. The interior of the mold tunnel T communicates with the interior of the melt chamber M via a pour opening 37 formed in the upper wall 32 of the mold tunnel (FIG. 4). The mold carriage 35 may be advanced to position each mold 36 successively beneath the pour opening 37 so that the mold may be filled with molten metal from furnace 20.

A sliding gate valve 38 is mounted just above the pour opening 37 to permit isolating the interior of the mold tunnel T from the interior of the melt chamber M. With the gate valve 38 in the closed position, the melt chamber M can remain under vacuum while the mold tunnel may be opened so that the mold carriage 35 may be removed from the mold tunnel and filled molds 36 may be removed from the mold carriage and replaced by empty molds. This is accomplished by opening the sliding wall or gate 26 at the end of the mold tunnel and transporting the mold carriage 35 along the rails 34 to the outside of the mold tunnel to the position shown in FIGS. 2 and 3. The mold carriage 35 may be propelled along the rails 34 by any suitable actuator or propulsion device. In the embodiment illustrated, the mold carriage 35 is moved by a thrust motion rigid chain or "push chain" 39 which is housed in the mold tunnel and connected to the wheeled mold carriage 35. Rigid chains of this type are commercially available, for example from Serapid USA, Inc. of Troy, Mich.

As best seen in FIG. 4, the induction melting furnace 20 is mounted for tilting movement from a normally upright position for melting with its axis extending generally vertically, and to a tilted position shown in solid lines for pouring the molten metal from the furnace. For this purpose, trunnions 21 extending laterally from opposite sides of the furnace are supported by stationary pillow blocks 22. A hydraulic actuator 23 controls movement of the furnace from the upright melting position to the tilted pour position where the molten metal flows from the furnace through a suitable pour spout 24. A launder 40, positioned above the pour opening 37 receives the molten metal from the furnace. The launder is designed to collect the stream of molten metal poured from the furnace and to direct the metal flow through a pouring nozzle. As best seen in FIG. 7, the launder 40 is equipped with a vertically actuable pour stopper 42 which is located directly above the pour opening 37 and serves to control the flow of molten metal through an opening provided in the lower side of the launder. The pour stopper 42 thus allows for controlling the flow of molten metal from the launder during the filling of successive molds 36.

Figure 6:
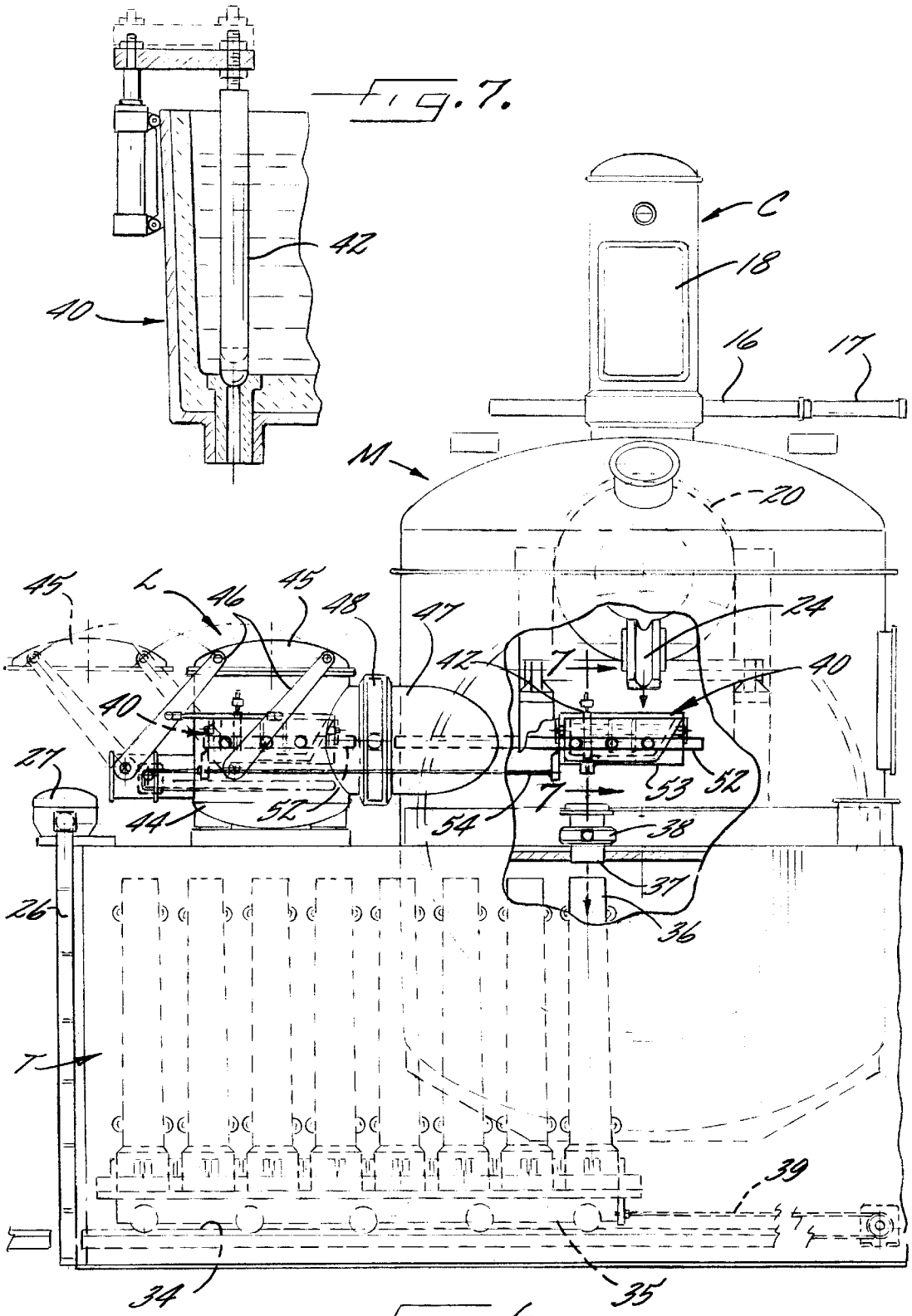
FIG. 6 is an elevational view of the rear side of the melting system, taken substantially along the line 6—6 of FIG. 5, and showing the mold tunnel.

As previously noted, the vacuum induction melting system is designed to be operated on a semi-continuous basis for melting successive heats of metal in the induction furnace until such time as it becomes necessary to shut down the melting system for purposes of replacing and rebuilding the melting furnace. During these extended periods of operation, it is typically necessary to remove the launder 40 after each heat and to replace it with a fresh launder. For this purpose, the vacuum induction melting system 10 is equipped with a launder chamber L which is joined to the melting chamber M on one side thereof. As seen in FIGS. 2 and 6, the launder chamber L has generally cylindrical side walls 44 and a removable lid or top wall 45. Pivot arms 46 are mounted to the lid 45 to facilitate moving the lid 45 from a closed position sealed to the side walls 44 to a laterally offset opened position providing access to the interior of the launder chamber. With the lid in the open position, the launder can be lifted and removed from the launder chamber by suitable means, such as a crane (not shown). The launder chamber L communicates with the interior of the melt chamber M through an opening 47 formed in the side wall 12 of the melt chamber. A sliding isolation valve 48 is mounted adjacent the opening 47 to permit sealing and isolating the interior of the chamber L from the mold from the melt chamber M. The isolation valve 48 makes it possible to remove and replace a launder from the launder chamber without breaking the vacuum in the main melt chamber M. Thus, for example, once a fresh launder 40 has been placed in the launder chamber L, the lid 45 is sealed and with the lid sealed and the isolation valve 48 closed, the launder chamber is pumped down to vacuum conditions via a suction port 49 formed in the launder chamber L. The suction port 49 is connected to the evacuation system V.

With a vacuum established in the launder chamber L, the isolation valve 48 is opened. Now the launder can be moved laterally from the launder chamber 40 to a pour position inside the melt chamber M. For this purpose, the launder 40 is supported by a launder transport assembly which moves the launder from a loading position within the launder chamber to a pour position within the melt chamber where it is positioned for receiving molten metal from furnace. The launder transport assembly includes a pair of laterally extending rails 52 and a wheeled launder carriage 53 which rides on the rails 52 for moving the launder laterally. A suitable propulsion system or actuator propels the launder transport assembly between the pour position and the loading position. In the embodiment illustrated, the launder transport assembly is moved by a thrust motion rigid chain or "push chain" 54 which is housed in the launder chamber 40 and connected to the wheeled launder carriage 53. Rigid chains of this type are commercially available, for example from Serapid USA, Inc. of Troy, Mich.

Figure 8A:
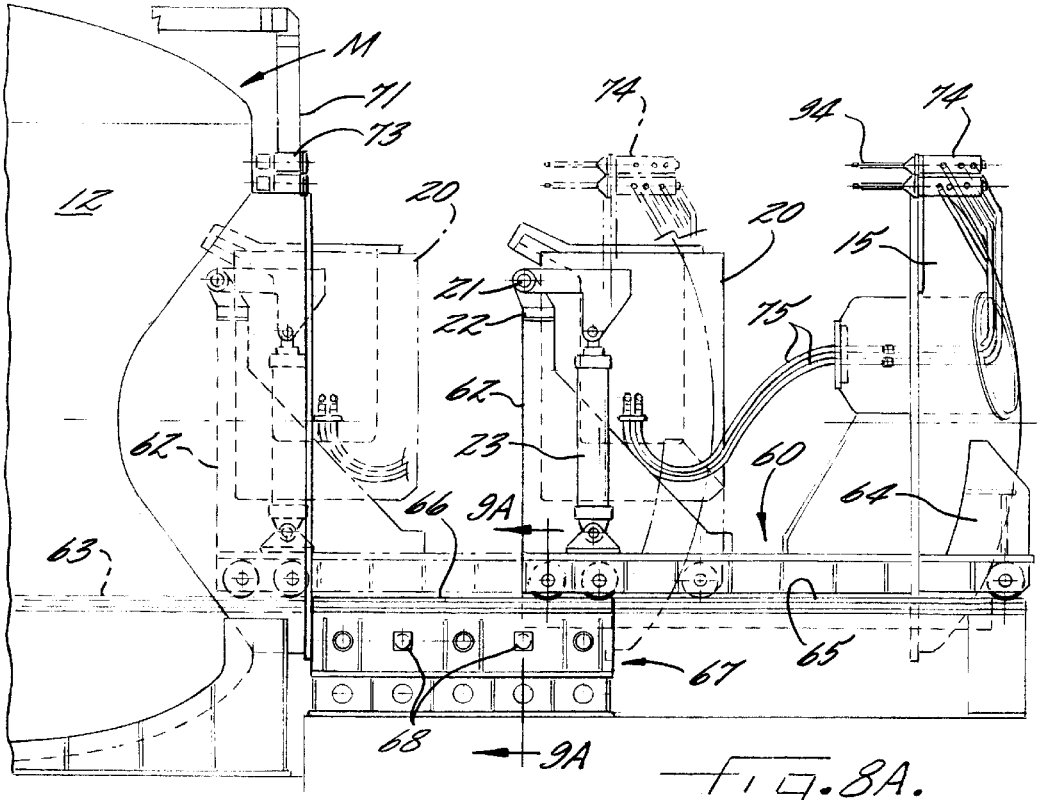
FIGS. 8A and 8B are side elevational views of the melt chamber in the opened and closed positions, respectively.
Figure 8B:
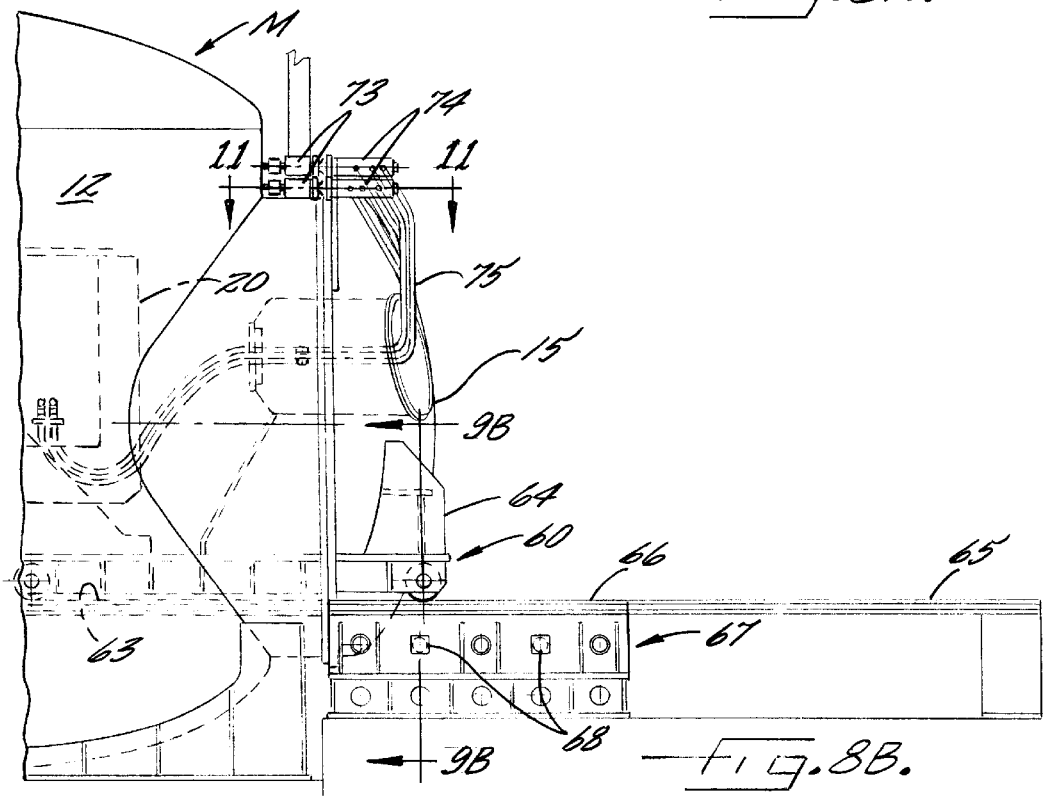
Figure 9A:
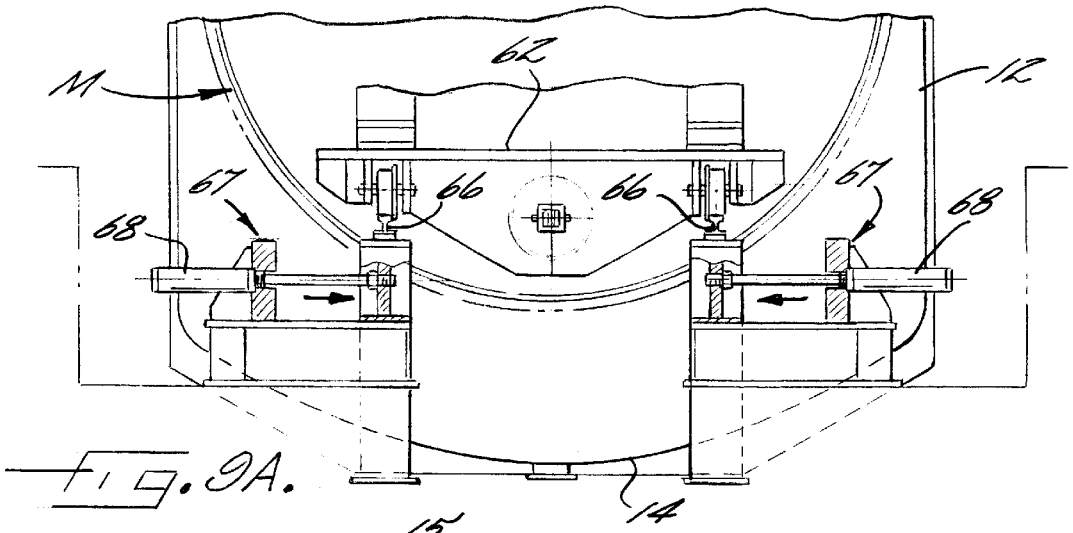
FIGS. 9A and 9B are fragmentary front cross sectional views taken substantially along the lines 9A—9A and 9B—9B respectively, showing how the rails are repositioned as the furnace is removed from the melt chamber.
Figure 9B:
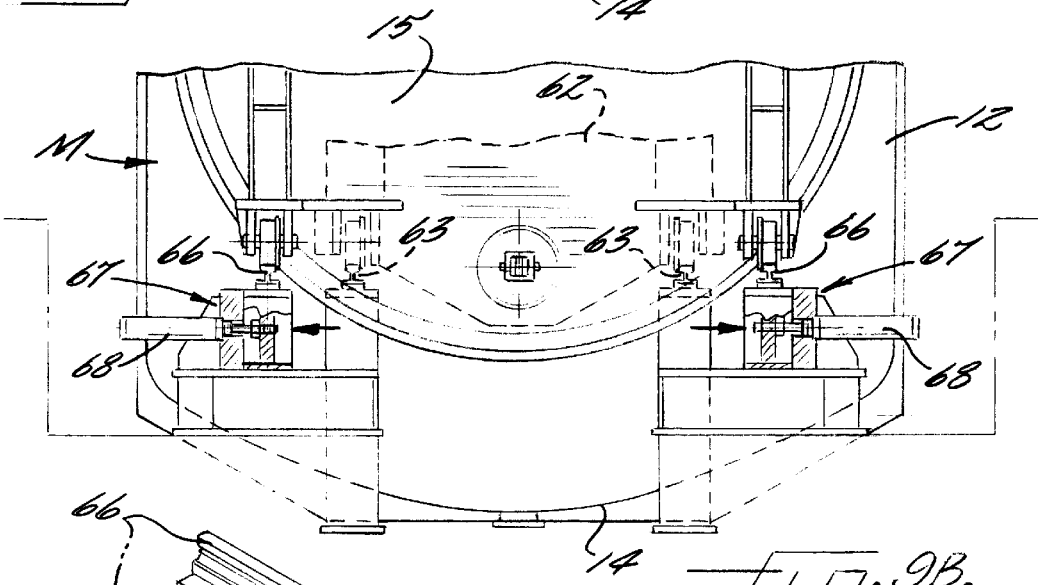
Figure 10:
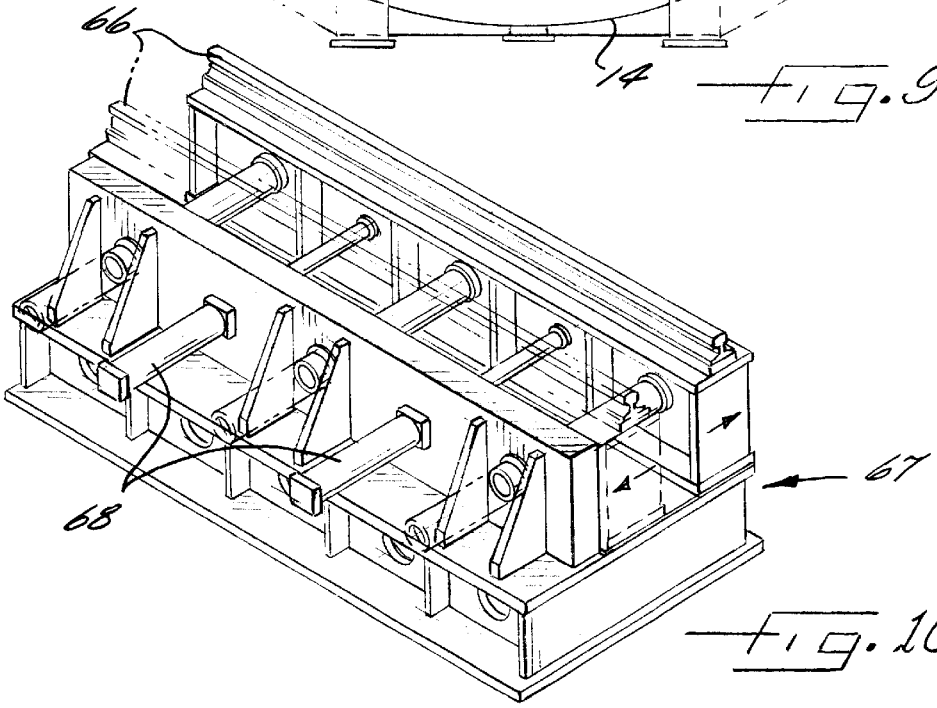
FIG. 10 is a detailed perspective view showing the rail positioning mechanism.

After a series of heats has been melted in the induction furnace, it becomes necessary to rebuild the furnace by replacing its refractory lining. In accordance with the present invention, the induction furnace 20 can be easily removed from the melt chamber M for rebuilding. As shown in FIG. 3 and in FIGS. 8A and 8B, the moveable side wall 15 of the melt chamber, which is normally closed and sealed to the fixed side wall 12 can be unsealed and moved laterally so that the furnace 20 is removed from the side of the melt chamber M. A furnace transport assembly, generally indicated by the reference character 60, supports both the moveable side wall 15 of the melt chamber M and the induction melting furnace 20 and provides for moving the side wall 15 and the furnace 20 as a unit laterally to the position shown in FIG. 3. The furnace transport assembly 60, more specifically, includes laterally extending rails and cooperating carriages which ride upon the rails. Supporting the induction furnace, is a wheeled furnace carriage 62. When the furnace is in its normal position within the melt chamber, the furnace carriage 62 rests upon a pair of relatively narrow gauge laterally extending fixed rail segments 63 located within the melt chamber M. The moveable side wall 15 is supported by a wider gauge wheeled carriage 64. The furnace transport assembly 60 also includes a pair of wide gauge fixed rail segments 65 mounted at a distal location from the melt chamber M and a pair of moveable rail segments 66 at a location proximal to the melt chamber. Cooperating with the moveable rail segments is a rail adjustment mechanism 67 which adjusts the spacing of the moveable rail segments 66 from a wide gauge corresponding to the gauge of the wide gauge fixed rail segments 65 and to a narrow gauge corresponding to the gauge of the narrow fixed rail segments 63 located inside the melt chamber. The rail adjustment mechanism 67 includes hydraulic cylinders 68 for moving the moveable rail segments 66.

With the furnace located in its normal position inside the melt chamber, the furnace carriage 62 is supported by the narrow fixed rail segments 63 inside the melt chamber M and the wider gauge wheeled carriage 64 which supports the moveable side wall 15 is supported by the moveable rail segments 66 in the wide gauge position. When the moveable side wall 15 is unsealed from the fixed side walls 12 for removing the furnace from the melt chamber, the weight of the moveable side wall is supported by the moveable rail segments 66 until the wheels of the carriage 64 reach the wide gauge fixed rail segments 65. At this point, lateral movement of the furnace transport assembly is stopped while the moveable rail segments are adjusted from the wide gauge position to the narrow gauge position matching the narrow fixed rail segments 63. Then, as the furnace transport assembly 60 is again moved laterally to withdraw the furnace fully from the melt chamber, the furnace carriage 62 is supported by the moveable rail segments 66 in the narrow gauge position, while the wider gauge carriage 64 supporting the side wall 15 continues to be supported by the wide gauge fixed rail segments 65. This moveable rail arrangement makes it possible for the moveable side wall to have the necessary clearance from the rails to allow for sealing of the moveable side wall 15 to the fixed side walls 12.

Once the furnace has been removed from the melt chamber in the manner described, it can be lifted from the furnace carriage 62 and transported to a convenient nearby location for rebuilding and a newly rebuilt furnace 20 may be positioned on the furnace carriage 62. In this way, the vacuum induction melting system can be quickly put back into service with minimum down time, thus increasing the efficiency and productivity of the melting system.

Electrical power for the induction melting furnace comes from a power supply 70 along a fixed power buss 71. The power buss 71 terminates at an electrical connector coupling 72 having a fixed female component 73 mounted to the fixed side wall 12 of the melt chamber M and a moveable male component 74 mounted to the moveable side wall 15. The electrical power then passes along flexible conductors 75 through the moveable side wall with the opposite end of the flexible conductors being electrically connected to the induction coils of the furnace 20. When the furnace is in the closed operating position, the connector coupling 72 provides a continuous arc free conductive path for the electrical power to pass from the fixed power buss 71 to the flexible electrical conductors 75. When the furnace is to be removed from the melt chamber, the components 73, 74 of connector coupling 72 are disconnected.

Figure 11:
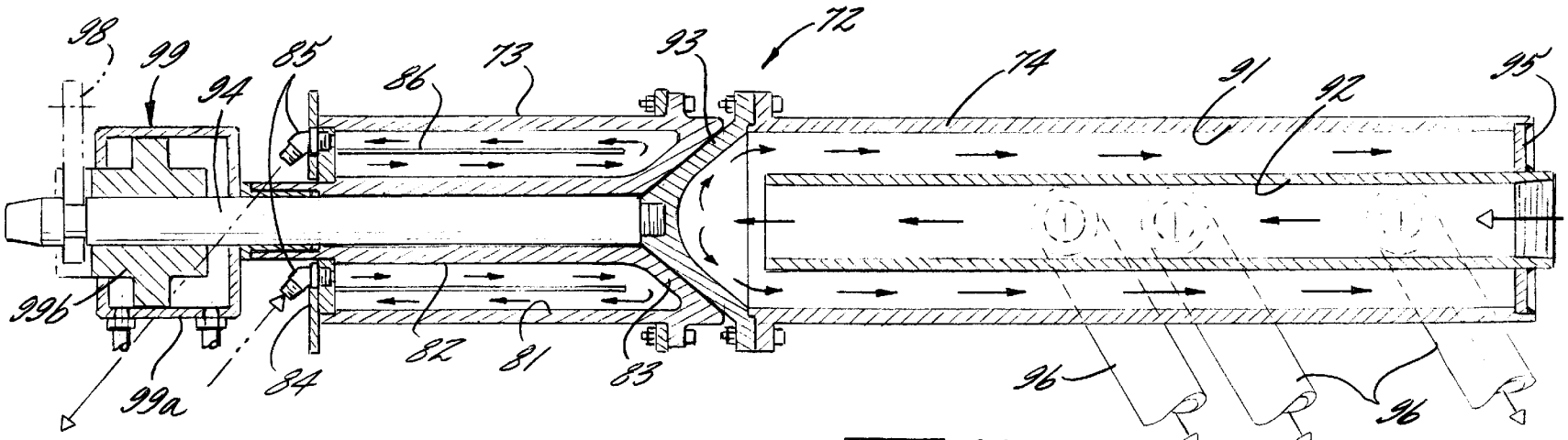
FIG. 11 is a cross-sectional view of the electrical connector taken along the line 11—11 of FIG. 8B.

The connector coupling 72 is shown in greater detail in FIG. 11 in the assembled or connected position. The fixed female component 73 is of a hollow tubular configuration defined by a cylindrical outer wall 81 and a cylindrical inner wall 82. The cylindrical inner wall 82 defines a cylindrical opening or bore extending axially through the coupling component. At its outer end, the inner and outer tubular walls 81, 82 are joined by an end wall 83 which forms a concave frustoconical surface at the outer end of the component 73. At the opposite end, an end wall 84 joins the inner and outer tubular walls 81, 82, forming a sealed space between the inner and outer walls 81, 82 for circulation of a cooling fluid, such as water. As shown, couplings 85 pass through the end wall 84 to permit circulating the cooling fluid through the sealed space. A cylindrical baffle 86 is mounted between the inner and outer walls to direct the flow of cooling fluid.

The movable male component 74 includes outer and inner cylindrical walls 91, 92 which are joined at the outermost end by an end wall 93 which is of a convex frustoconical configuration. A shaft 94 extends axially from the convex end wall 93. An end wall 95 at the opposite end of the component 74 seals the space between the inner and outer walls 92, providing for the circulation of cooling fluid through the interior space of component 74. As shown, cooling fluid enters the component through the interior of the cylindrical inner wall 92 and is discharged from the component through openings formed in the outer wall 91 and connected to suitable conduits 96. The cooling fluid circuit for the male component 74 is separate from the cooling fluid circuit for the female component 73, thus making it possible to readily connect and disconnect the connector for opening of the furnace without having to disturb the cooling systems.

When the connector coupling is connected, as is shown in FIG. 11, the convex frustoconical outer surface of end wall 93 is in intimate contact with the concave frustoconical outer surface of end wall 83 to provide a conductive path for electrical current. To prevent arcing, the two surfaces are forced tightly against one another and are maintained under pressure. More specifically, the end of shaft 94 is engaged by a clamp arm 98, after passing through a mechanical actuator 99, such as a solenoid or fluid powered cylinder. In the illustrated embodiment, the actuator 99 is a hollow bore double acting hydraulic cylinder. The cylinder has a cylindrical housing or body 99*a* and an axially movable hollow piston 99*b*. When piston 99*b* is expanded axially, it forces the shaft 94 axially so that the surface 93 is held tightly against frustoconical concave surface 83.

From the foregoing, it will be apparent that the present invention provides an effective system which enables the vacuum induction furnace to be operated for extended periods of time while successive melts are produced and are cast into molds. Since the charging chamber, the launder chamber and the mold tunnel can each be individually isolated from the melt chamber, it is possible to carry out many of the operations which are necessary in the melting operation simultaneously. For example, while the furnace is being filled with raw materials and while the furnace is melting the raw materials, the mold chamber can be opened to allow for removing the previous batch of filled molds and for positioning new molds within the mold tunnel ready for receiving the molten metal. While the furnace is operated continuously, successive batches of raw material can be introduced into the charging chamber and then into the furnace itself. Also, the launder can be removed and replaced while the melt chamber is evacuated and the furnace is operating. Once it becomes necessary to open the melt chamber and remove the furnace for rebuilding, this can be carried out quickly and efficiently by virtue of the side opening melt chamber and the associated furnace transport assembly.

Many modifications and other embodiments of the invention will come to mind to one skilled in the art to which this invention pertains having the benefit of the teachings presented in the foregoing description and the associated drawings. Therefore, it is to be understood that the invention is not to be limited to the specific embodiment disclosed and that modifications and other embodiments are intended to be included within the scope of the appended claims. Although specific terms are employed herein, they are used in a generic and descriptive sense only and not for purposes of limitation.

That which is claimed:

1. A vacuum induction melting system comprising:

a melt chamber having a top wall, a bottom wall and side walls defining an airtight enclosure, said side walls including a fixed side wall and a movable side wall detachably connected to the fixed side wall;

an induction furnace located within said melt chamber;

a furnace transport assembly connected to said movable side wall and to said induction furnace and operable for transporting said movable side wall and said furnace laterally until said furnace is removed from said melt chamber; said furnace transport assembly including laterally extending rails positioned for receiving and supporting said moveable side wall and said furnace;

a charging chamber communicatively connected to said melt chamber adjacent its upper end, said charging chamber including a door providing access to the interior of the charging chamber so that a charge of raw materials can be placed therein;

an isolation valve located between said melt chamber and said charging chamber and being movable between open and closed positions, the closed position isolating the charging chamber from the melting chamber to allow for loading of raw materials into the charging chamber through said door, and the open position providing communication between the charging chamber and the melt chamber to permit adding the charge of raw materials to said furnace;

a mold tunnel connected to said melt chamber adjacent its lower end, said mold tunnel including a pour opening communicating with said melt chamber and through which molten metal poured from said furnace can enter the mold tunnel;

a mold carriage positioned within said mold tunnel for receiving and carrying at least one mold adapted for receiving molten metal;

an isolation valve located between said melt chamber and said mold tunnel and being movable between an open and closed position, the closed position isolating the mold tunnel from the melt chamber to allow for removing said mold carriage from said mold tunnel for loading or unloading of molds thereon, and the open position providing communication between the mold tunnel and the melt chamber to permit filling the molds with molten metal;

a mold transport assembly for moving said mold carriage from a pouring position within said mold tunnel to a loading position located outside of said mold tunnel; and an evacuation system communicatively connected to said melt chamber, charging chamber, and mold tunnel for producing a vacuum therein.

2. A melting system according to claim 1 additionally including a power buss connected to a source of electrical power, a connector coupling carried by said melt chamber and electrically connected to said power buss, power conductors electrically connected to said connector coupling and conducting electrical power to said induction furnace, and wherein said connector coupling includes a stationary first component carried by said melt chamber and a movable second component mounted for movement with said movable side wall, said second component being detachably connected to said stationary first component for disconnecting the electrical connection between said power bus and said power conductors.

3. A melting system according to claim 1 Wherein said mold tunnel extends along an elongate generally horizontal axis and includes a pair of elongate longitudinally extending rails, and wherein said mold carriage is a wheeled carriage mounted for longitudinal movement along said rails within said mold tunnel.

4. A melting system according to claim 3 wherein said mold transport assembly includes a push-chain mounted to said mold carriage within said mold tunnel and operable for propelling the mold carriage along said rails.

5. A melting system according to claim 3 wherein said mold carriage has an elongate laterally extending upper surface adapted for receiving and supporting thereon a series of molds arranged in a rows and wherein said mold transport assembly is operable to move said mold carriage longitudinally for successively positioning each of the molds beneath said pour opening to receive molten metal.

6. A melting system according to claim 3 wherein said mold tunnel includes a door located at one end of the elongate mold tunnel to allow for removing said mold carriage from said mold tunnel, and additionally including a pair of rails extending longitudinally outside of the mold tunnel beyond said door for receiving the mold carriage when the mold carriage is removed from said mold tunnel for loading or unloading of molds thereon.

7. A melting system according to claim 1 additionally including:

a launder chamber communicatively connected to said melt chamber, said launder chamber including a door providing access to the launder chamber;

a launder adapted for receiving molten metal from said furnace;

an isolation valve located between said melt chamber and said launder chamber and being movable between opened and closed positions, the closed position isolating the launder chamber from the melt chamber to permit positioning of said launder in a loading position within said launder chamber through said door thereof, and the open position providing communication between the launder chamber and the melt chamber to permit moving the launder to a pour position within said melt chamber;

a launder transport assembly cooperating with said launder for moving the launder from a loading position within said launder chamber to a pour position within said melt chamber where it is positioned for receiving molten metal poured from said furnace and for discharging the molten metal through said pour opening into said mold tunnel.

8. A melting system according to claim 7 wherein said launder transport assembly includes a push-chain mounted to said launder and operable for moving said launder between said loading position and said pour position.

9. A vacuum induction melting system comprising:

a melt chamber having a top wall, a bottom wall and side walls defining an airtight enclosure;

an induction furnace located within said melt chamber;

a charging chamber communicatively connected to said melt chamber adjacent its upper end, said charging chamber including a door providing access to the interior of the charging chamber so that a charge of raw materials can be placed therein;

a first isolation valve located between said melt chamber and said charging chamber and being movable between open and closed positions, the closed position isolating the charging chamber from the melting chamber to allow for loading of raw materials into the charging chamber through said door, and the open position providing communication between the charging chamber and the melt chamber to permit adding the charge of raw materials to said furnace;

a launder chamber communicatively connected to said melt chamber, said launder chamber including a door providing access to the launder chamber;

a launder adapted for receiving molten metal from said furnace;

a second isolation valve located between said melt chamber and said launder chamber and being movable between opened and closed positions, the closed position isolating the launder chamber from the melt chamber to permit positioning of said launder in a loading position within said launder chamber through said door thereof, and the open position providing communication between the launder chamber and the melt chamber to permit moving the launder to a pour position within said melt chamber;

a launder transport assembly cooperating with said launder for moving the launder from a loading position within said launder chamber to a pour position within said melt chamber where it is positioned for receiving molten metal poured from said furnace;

a mold tunnel communicatively connected to said melt chamber adjacent its lower end, said mold tunnel including a door for providing access to the interior of the mold tunnel;

a mold carriage positioned within said mold tunnel and adapted for receiving and carrying at least one mold;

a third isolation valve located between said melt chamber and said mold tunnel and being movable between an open and closed position, the closed position isolating the mold tunnel from the melt chamber to allow for removing said mold carriage from said mold tunnel through said door for loading or unloading of molds thereon, and the open position providing communication between the mold tunnel and the melt chamber to permit filling the molds with molten metal from said launder;

a mold transport assembly for moving said mold carriage from a pouring position within said mold tunnel to a loading position located outside of said mold tunnel; and an evacuation system communicatively connected to said melt chamber, charging chamber, launder chamber and mold tunnel for producing a vacuum therein.

10. A vacuum induction melting system comprising:

an induction furnace adapted for receiving raw materials for melting;

a melt chamber having a top wall, a bottom wall and side walls defining an airtight enclosure surrounding said induction furnace; said side walls including a fixed side wall and a cooperating movable side wall detachably connected to the fixed side wall;

a furnace transport assembly connected to said movable side wall and to said induction furnace and operable for transporting said movable side wall and said furnace laterally until said furnace is removed from said melt chamber;

a power buss connected to a source of electrical power;

a connector coupling electrically connected to said power buss, said connector coupling including a stationary first component carried by said melt chamber and a movable second component mounted for movement with said movable side, wall, said second component being detachably connected to said stationary first component for disconnecting the electrical connection between said power bus and said power conductors;

power conductors electrically connected to said connector coupling and to said induction furnace for conducting electrical power to said induction furnace; and an evacuation system communicatively connected to said melt chamber for producing a vacuum therein.

11. A melting system according to claim 10 wherein said furnace transport assembly includes a wheeled carriage supporting said moveable side wall and said furnace, and laterally extending rails positioned for receiving and supporting said wheeled carriage.

12. A melting system according to claim 11 wherein said laterally extending rails include:

a pair of fixed rail segments mounted at a relatively narrow gauge within said melt chamber and arranged for supporting said wheeled carriage when it is located inside the melt chamber, a pair of fixed rail segments mounted at a relatively wide gauge at a location exteriorly of said melt chamber and arranged for supporting said wheeled carriage when it is removed from the melt chamber, and a pair of movable rail segments located between said narrow gauge rail segments and said wide gauge rail segments, and including a rail adjacent mechanism for adjusting the spacing of the movable rail segments between said wide gauge and said narrow gauge.

13. A melting system according to claim 12 wherein said wheeled carriage includes a wide gauge carriage mounted to support said moveable side wall and having wheels spaced at a gauge corresponding to said wide gauge rail segments and a furnace support carriage having wheels spaced to engage said narrow gauge rail segments.

14. A melting system according to claim 10 wherein said first and second connector components comprise a pair of axially aligned tubular bodies having opposing cooperating end surfaces which contact one another to form a conductive path when the connector coupling is connected.

15. A melting system according to claim 14 additionally including a clamp for forcing said cooperating end surface tightly together when the connector coupling is connected.

16. A melting system according to claim 15 including a shaft extending axially from said end surface of one of said connector components, and wherein the other of said connector components has an axial bore through which said shaft extends when the connector components are assembled, the length of said shaft being such that the end thereof projects from the opposite end of said other connector component, and wherein said clamp comprises a clamp arm mounted for engaging the projecting end of said shaft and an actuator for moving the shaft axially to force the cooperating end surfaces tightly against one another.

17. A vacuum induction melting system comprising:

a melt chamber having a top wall, a bottom wall and side walls defining an airtight enclosure, said side walls including a fixed side wall and a movable side wall detachably connected to the fixed side wall;

an induction furnace located within said melt chamber;

a furnace transport assembly connected to said movable side wall and to said induction furnace and operable for transporting said movable side wall and said furnace laterally until said furnace is removed from said melt chamber; said furnace transport assembly including laterally extending rails positioned for receiving and supporting said moveable side wall and said furnace, said rails including a pair of fixed rail segments at a lateral location distal from said melt chamber and a pair of movable rail segments at a location proximal to said melt chamber, and including a rail adjustment mechanism for adjusting the spacing of the movable rail segments from a wide gauge corresponding to the gauge of said fixed rail segments and to a narrow gauge;

a charging chamber communicatively connected to said melt chamber adjacent its upper end, said charging chamber including a door providing access to the interior of the charging chamber so that a charge of raw materials can be placed therein;

an isolation valve located between said melt chamber and said charging chamber and being movable between open and closed positions, the closed position isolating the charging chamber from the melting chamber to allow for loading of raw materials into the charging chamber through said door, and the open position providing communication between the charging chamber and the melt chamber to permit adding the charge of raw materials to said furnace;

a mold tunnel connected to said melt chamber adjacent its lower end, said mold tunnel including a pour opening communicating with said melt chamber and through which molten metal poured from said furnace can enter the mold tunnel;

a mold carriage positioned within said mold tunnel for receiving and carrying at least one mold adapted for receiving molten metal;

an isolation valve located between said melt chamber and said mold tunnel and being movable between an open and closed position, the closed position isolating the mold tunnel from the melt chamber to allow for removing said mold carriage from said mold tunnel for loading or unloading of molds thereon, and the open position providing communication between the mold tunnel and the melt chamber to permit filling the molds with molten metal;

a mold transport assembly for moving said mold carriage from a pouring position within said mold tunnel to a loading position located outside of said mold tunnel; and an evacuation system communicatively connected to said melt chambers charging chamber, and mold tunnel for producing a vacuum therein.

18. A melting system according to claim 17 wherein said furnace transport assembly includes a wide gauge carriage mounted to support said movable side wall and having wheels spaced at a gauge corresponding to said fixed rail segments and a furnace support carriage having wheels spaced to engage said movable rail segments at said narrow gauge position.

* * * * *